United States Patent [19]

Bromley et al.

[11] 4,287,713

[45] Sep. 8, 1981

[54] PROCESS FOR LOW-TORQUE TEXTURED YARN

[75] Inventors: James E. Bromley; Frank Stutz, both of Pensacola, Fla.

[73] Assignee: Monsanto Company, St. Louis, Mo.

[21] Appl. No.: 59,014

[22] Filed: Jul. 19, 1979

Related U.S. Application Data

[63] Continuation-in-part of Ser. No. 866,745, Jan. 3, 1978, abandoned.

[51] Int. Cl.[3] ..... D02G 1/20

[52] U.S. Cl. ..... 57/288; 57/290; 264/290.5

[58] Field of Search ..... 264/103, 210.8; 57/248, 57/247, 288, 287, 290

[56] References Cited

U.S. PATENT DOCUMENTS

| | | | |
|---|---|---|---|
| 3,387,327 | 6/1968 | Privott et al. | 264/168 |
| 3,623,939 | 11/1971 | Ono et al. | 428/397 |
| 3,708,970 | 1/1973 | MacFarlane | 57/247 |
| 3,886,722 | 6/1975 | Hori et al. | 57/288 |
| 3,920,784 | 11/1975 | Nakagawa et al. | 428/369 |
| 3,956,878 | 5/1976 | Schaffer et al. | 57/288 |
| 4,035,883 | 7/1977 | Bond | 264/210.8 |
| 4,100,725 | 7/1978 | Magel | 57/248 |
| 4,105,740 | 8/1978 | Yasuda et al. | 264/210.8 |
| 4,169,349 | 10/1979 | Talbot | 57/248 |

FOREIGN PATENT DOCUMENTS

| | | | |
|---|---|---|---|
| 51-58522 | 5/1976 | Japan | 264/210.8 |
| 51-70343 | 6/1976 | Japan | 57/248 |

*Primary Examiner*—Jay H. Woo
*Attorney, Agent, or Firm*—Kelly O. Corley

[57] ABSTRACT

Spun yarn having torqueless latent crimp is draw-textured, producing a drawn textured yarn which is substantially torque-free.

3 Claims, No Drawings

PROCESS FOR LOW-TORQUE TEXTURED YARN

This application is a continuation-in-part of United States patent application Ser. No. 866,745 filed Jan. 3, 1978 now abandoned.

The invention relates to a process for producing a reduced-torque textured polyester yarn. More particularly, it relates to such a process wherein the spun feed yarn is chosen to have certain properties selected such that the drawn yarn will have substantial texture and yet be substantially torque-free.

False-twist texturing of polyester yarns is well known in the art, and customarily includes a second heating step (after the yarn has passed through the false-twister) under controlled tension in order to reduce the torque in the yarn. Such known processes use conventional POY (partially oriented yarn) as the feed yarn, and are quite successful as long as the drawn yarn denier is lower than about 200. At a drawn denier of 250 or above, and particularly when the drawn yarn has a denier of at least 350, the second heating step temperature cannot be sufficiently high as to substantially eliminate torque in the yarn, else the yarn bulk would be unduly reduced. When such heavy deniers are desired, it is therefore customary to separately spin and draw-texture two smaller yarns of opposite torque directions, then ply the two smaller yarns to provide a balanced-torque final yarn of the desired denier. This customary procedure is thus cumbersome and expensive as compared to producing a singles yarn.

These and other difficulties with prior art practices are avoided by the present invention, which provides a particular feed yarn which during drawtexturing surprisingly does not develop objectionable torque.

According to a primary aspect of the invention, there is provided a process for producing a reduced-torque textured polyester yarn, comprising selecting a spun polyester yarn having an elongation of 55–195% and having sufficient torqueless latent crimp to provide when hot-drawn to an elongation of 30% a bulk of at least 8%, and draw-texturing the spun yarn at a temperature above the second order transition temperature to a drawn yarn having a denier of at least 250 and an elongation between 10 and 45%.

According to another aspect of the invention, the spun yarn is draw-textured to an elongation between 20 and 35%.

According to another aspect of the invention, the drawn yarn has a denier of at least 350.

Other aspects will in part be obvious and will in part be set forth in the following detailed description of the invention.

It has been discovered that heavy denier low-or-zero-torque yarns can be produced efficiently by using as feed yarns therefor in a draw-texturing process a spun polyester yarn having an elongation of 55–195% and having sufficient latent crimp to provide when hot-drawn to an elongation of 30% a bulk of at least 8%, and draw-texturing the spun yarn at a temperature above the second order transition temperature to a drawn yarn having a denier of at least 250 and an elongation between 10 and 45%. Such spun yarns can be produced by combining two different molten streams with different rheological properties, as in Privott U.S. Pat. No. 3,387,327, or by spinning a molten non-round cross-sectional stream and preferentially quenching one portion of the cross-section, as in Ono U.S. Pat. No. 3,623,939 and Nakagawa U.S. Pat. No. 3,920,784. These three patents are incorporated herein by reference. With these spinning systems, a spinning speed of about 3000 meters per minute will provide an elongation within the range of 55–195% for normal deniers per filament of about 4–8. For other deniers per filament, the desired elongation range may be obtained by selection of spinning speed. As is known, higher spinning speeds give lower elongations and vice versa.

EXAMPLE I

This is illustrative of the problem. Polyethylene terephthalate polymer of normal molecular weight for apparel yarns is conventionally melt spun at a melt temperature of 290° C. into a quench zone supplied with transverse quenching air at a temperature of 20° C. The quenching air has an average speed of 15 meters per minute, 68 round spinneret orifices are employed having diameters of 0.38 mm., and the yarn is wound at 3000 meters per minute to give a spun yarn with a denier of 550 and an elongation of 130%.

The spun yarn is simultaneously drawn and textured (draw-textured) on a Barmag FK-6 machine equipped with friction-twist aggregates of the type disclosed in Yu U.S. Pat. No. 3,973,383, the disclosure of which is incorporated herein by reference. The primary heater temperature is 200° C., the draw ratio is 1.70, and the texturing windup speed is 300 meters per minute.

A Lawson tube knitted from this yarn exhibits severe torque unless the secondary heater (after the false-twist aggregate and prior to texturing windup) has a temperature so high as to substantially reduce the yarn bulk.

EXAMPLE II

This is an example according to the invention, spun the same as in Example I above, except that each filament of the feed yarn is spun from a spinneret orifice having three slots radiating from a common center and spaced 120° apart to give a tri-lobal filament cross-section of the general type indicated in FIG. 1B of U.S. Pat. No. 3,623,939. The 68- filament spun yarn has a denier of 550.

The spun yarn is draw-textured as in Example I above.

A Lawson tube knitted from this yarn exhibits virtually no torque when the secondary heater has a temperature of 190°.

EXAMPLE III

This sample simply characterizes the spun yarns of Examples I and II. Each spun yarn is drawn over a hot shoe at 200° C. at a rate of 360 meters per minute and at a draw ratio of 1.70. The drawn spun yarns then have their degree of latent bulk determined as follows.

The drawn yarn packages are conditioned at 20° C. and 72% relative humidity for 24 hours, after which 25 meters of yarn are stripped from each bobbin and discarded. A skein having a skein denier of 6250 and a skein circumference of 1.125 meters (that is, 6250/yarn denier = revolutions of 1.125 meter skein reel) is formed under a yarn tension of 0.035 grams per denier while skeining. A 1000 gram weight is hung from the bottom of the skein while the top of the skein is suspended from a small hook, and, after 30 seconds, the skein length Li is determined. The 1000 gram weight is then replaced by a weight of 0.6 grams and the skein is then placed in a 120° C. oven for 5 minutes. The skein is then removed, conditioned for 1 minute at room temperature, and a 20 gram weight is added to the 0.6 gram weight. After 30 seconds, the skein length is measured to determine Lf. The yarn bulk in percent is then Li-Lf/Li×100.

The spun yarn in Example I has a bulk of 4.7%, while the spun yarn in Example II has a bulk of 11.3. The textured yarns (run without energizing the second heater) have respective bulks of 61.5 and 77.7% when measured by the above bulk test. However, the Example II yarn surprisingly can be directly used as a high-bulk, substantially-zero-torque yarn, while the Example I yarn cannot be so used. Substantially torque-free high bulk yarns according to the invention are thus usable for a wide variety of knitted and woven fabrics. If the second heater is used and set at a sufficiently high temperature to substantially eliminate torque from the Example I yarn, the desirable bulk level is drastically reduced.

The term "polyester" as used herein means those polymers of fiber-forming molecular weight composed of at least 85% by weight of an ester of a dihydric alcohol and terephthalic acid. As is known, such polymers are made commerically by direct esterification of the alcohol with the acid, or by an ester interchange reaction.

What is claimed is:

1. A process for producing a low-torque textured polyester yarn, comprising:

a. selecting a spun polyester yarn having an elongation of 55–195% and having sufficient torqueless latent crimp to provide when hot-drawn at 200° C. to an elongation of 30% a bulk of at least 8%, and b. draw-texturing said spun yarn at a temperature above the second order transition temperature to a drawn yarn having a denier of at least 250 and an elongation between 10 and 45%.

2. The process defined in claim 1, wherein said spun yarn is draw-textured to an elongation between 20 and 35%.

3. The process defined in claim 1, wherein said drawn yarn has a denier of at least 350.

* * * * *